US006700544B2

(12) United States Patent
Anderson

(10) Patent No.: US 6,700,544 B2
(45) Date of Patent: Mar. 2, 2004

(54) NEAR-FIELD PLASMA READER

(76) Inventor: Theodore R. Anderson, 7 Martin Rd., Brookfield, MA (US) 01506

( * ) Notice: Subject to any disclaimer, the term of this patent is extended or adjusted under 35 U.S.C. 154(b) by 31 days.

(21) Appl. No.: 10/067,715

(22) Filed: Feb. 5, 2002

(65) Prior Publication Data

US 2003/0146879 A1 Aug. 7, 2003

(51) Int. Cl.[7] ..... H01Q 1/26; H01Q 11/12
(52) U.S. Cl. ..... 343/701; 343/742
(58) Field of Search ..... 343/701, 741, 343/742, 866, 867, 743, 744, 868, 870; H01Q 1/26, 11/12

(56) References Cited

U.S. PATENT DOCUMENTS

| | | | |
|---|---|---|---|
| 3,707,711 | A | 12/1972 | Cole et al. |
| 3,719,948 | A | 3/1973 | Mueller |
| 3,852,755 | A | 12/1974 | Works et al. |
| 3,914,766 | A | 10/1975 | Moore |
| 4,101,902 | A | 7/1978 | Trigon |
| 4,353,070 | A | 10/1982 | Pyee |
| 4,873,531 | A | 10/1989 | Heddebaut et al. |
| 4,949,094 | A | 8/1990 | Yuki |
| 5,293,172 | A | 3/1994 | Lamberty et al. |
| 5,465,099 | A | 11/1995 | Mitsui et al. |
| 5,723,912 | A | 3/1998 | Ahrabian et al. |
| 5,751,227 | A | 5/1998 | Yoshida et al. |
| 5,933,120 | A | 8/1999 | Manasson et al. |
| 5,963,169 | A | 10/1999 | Anderson et al. |
| 6,087,992 | A | 7/2000 | Anderson |
| 6,100,850 | A | 8/2000 | Utsumi |
| 6,118,407 | A | 9/2000 | Anderson |
| 6,157,347 | A | 12/2000 | Robertson |
| 6,169,520 | B1 | 1/2001 | Anderson |
| 6,211,836 | B1 | 4/2001 | Mnasson et al. |
| 6,369,763 | B1 * | 4/2002 | Norris et al. ..... 343/701 |

* cited by examiner

*Primary Examiner*—Hoanganh Le
(74) *Attorney, Agent, or Firm*—Notaro and Michalos P.C.

(57) ABSTRACT

A near-field plasma reader detects magnetic induction interference with objects having corresponding sensed loops to provide detection and communication between the reader and objects incorporating the sensed loops. The plasma reader has two or more plasma loop sensors in different orientations that are sequentially switched to scan across a range of directions without interference from adjacent loop antennas. The plasma reader is used for inventorying items, store checkouts and other wireless transactions.

20 Claims, 8 Drawing Sheets

NEAR-FIELD PLASMA READER

FIELD AND BACKGROUND OF THE INVENTION

The present invention relates generally to the field of plasma sensors operating in near-field conditions and in particular to a new and useful plasma sensor array used to detect the presence of an interactive element.

Near-field readers are generally known for use in scanning systems. Near-field reader systems take advantage of magnetic field interference between a powered transceiver and a powered or passive object to detect the presence of the object by receiving a return signal from the object with the transceiver.

Presently, card and label near-field readers are formed by metal loops which read data in the near electromagnetic field. In the near-field situation, for a loop antenna, the electric field is effectively zero and only the magnetic field is present. Thus, near field loop antennas use mutual inductance between active and passive loop antennas to cause the active loop antenna to receive data from the passive loop antenna. That is, the magnetic flux from one loop antenna induces a current in a second loop antenna having properties dependent on the current and voltage in the first loop. The magnetic flux interaction and induced current can be used to transmit information between the loop antennas because of the dependency. The near-field loop antennas can be more correctly considered loop sensors or loop readers, since there is no electric field interaction between the active source and a passive loop.

A problem with metal loops used in a sensing array is that even when they are not active, several loops arranged in a multiple orientation array still create unavoidable mutual inductance interferences between loops. That is, even if the metal loop sensors are sequentially activated, they still cause mutual interference with other ones of the loops. The interferences result in detuning of the loops in the array and special considerations must be made when forming arrays.

In order to optimize the strength of the mutual inductance field between an active loop sensor and a passive loop antenna, the antennas must be parallel to each other. If the antennas are perpendicular, the magnetic field is zero at the passive loop and there is no mutual induction. The strength of the magnetic field at the passive loop increases as the loops move from a perpendicular to a parallel orientation. For a device to effectively scan a region for a passive loop, a single loop must move through a variety of orientations. The range of effectiveness of an antenna is based on the orientation of the passive and active loops to each other and the diameter of the loop of the active sensor.

Patents describing scanning antenna systems using interaction between active and passive antennas include U.S. Pat. No. 3,707,711, which discloses an electronic surveillance system. The patent generally describes a type of electronic interrogation system having a transmitter for sending energy to a passive label, which processes the energy and retransmits the modified energy as a reply signal to a receiver. The system includes a passive antenna label attached to goods that interacts with transmitters, such as at a security gate, when it is in close proximity to the transmitters. The label has a circuit which processes the two distinct transmitted signals from two separate transmitters to produce a third distinct reply signal. A receiver picks up the reply signal and indicates that the label has passed the transmitters, such as by sounding an alarm.

U.S. Pat. No. 3,852,755 teaches a transponder which can be used as an identification tag in an interrogation system. An identification tag can be encoded using a diode circuit in which some diodes are disabled to produce a unique code. When the identification tag is interrogated by a transponder, energy from the transponder signal activates the electronic circuit in the tag and the code in the diode circuit is transmitted from the tag using dipole antennas. The transponder uses a range of frequencies to send a sufficiently strong signal to activate a nearby identification tag.

A vehicle identification transponder using high and low frequency transmissions is disclosed by U.S. Pat. No. 4,873,531. A transmitting antenna broadcasts both high and low frequency signals that are received through longitudinal slots in a transponder waveguide. Transverse pairs in the waveguide adjacent the longitudinal slots indicate a digital "1", while the absence of transverse pairs produces a digital "0". The high and low frequencies are radiated from the transverse pairs to high and low frequency receiving antennas. The transmitting and receiving antennas are fixed relative to each other and move with respect to the transponder.

U.S. Pat. No. 5,465,099 teaches a passive loop antenna used in a detection system. The antenna has a dipole for receiving signals, a diode for changing the frequency of the received signal and a loop antenna for transmitting the frequency-altered signal. The original transmission frequency is changed to a harmonic frequency by the diode.

As discussed above, near-field loop sensors or readers differ from far field loop antennas by the basic difference that in the near-field, the electric field is effectively zero and the magnetic field of an electromagnetic radiant source is controlling, while in the far field, it is the magnetic field that is effectively zero and the electric field controls. As will be appreciated, the relationships between sources and receivers are different as well due to the different distances and fields which affect communication between them.

Plasma antennas are a type of antenna known for use in far field applications. Plasma antennas generally comprise a chamber in which a gas is ionized to form plasma. The plasma radiates at a frequency dictated by characteristics of the chamber and excitation energy, among other elements.

Plasma antennas and their far field applications are disclosed in patents like U.S. Pat. Nos. 5,963,169, 6,118,407 and 6,087,992 among others. Known applications using plasma antennas rely upon the characteristics of electric fields generated by the plasma antenna in far field situations, rather than magnetic fields in near-field conditions.

SUMMARY OF THE INVENTION

It is an object of the present invention to provide a near-field scanning loop sensor array which eliminates interference between adjacent loop sensors in the array.

It is a further object of the invention to provide a near-field loop reader array which can be arranged to scan in multiple directions without concern for interference between array components.

Yet another object of the invention is to provide a near-field scanning array composed of switched plasma loop sensors.

A still further object of the invention is to provide an apparatus and method for scanning a volume for an interactive component containing a data using a plasma reader.

Accordingly, an array of plasma loop sensors which are sequentially made active to scan a space to identify an interactive object comprising a data source based on mutual inductance interaction of the scanning plasma reader with the data source. The data source can be a passive loop of any type.

As used herein, plasma loop sensor and plasma loop reader are intended to both mean a near-field active loop device having at least a section of plasma tube, as will be described further herein. The active loop device is a near-field electromagnetic transducer having a conductive plasma section. That is, the plasma loop reader or sensor can both generate a magnetic field and sense an interfering induction current caused by a nearby passive loop.

The array of plasma loop sensors are connected to a power source, which may include a frequency switching circuit, and to a sensor circuit. The power source provides power to each of the plasma loop sensors as determined by a sequential switch circuit to make the loop sensors active in turn. The sensor circuit is used to interpret signals received from the data source by each plasma loop sensor while it is active.

One or more plasma loop readers can be arranged in arrays in different orientations to form a sensor and then sequentially activated to simulate a change in orientation of the sensor without any physical movement of the plasma loops in the array. Since the inactive plasma loop sensors are effectively invisible to the active plasma loop reader, there is no interference created between them. The plasma loops can be activated and deactivated in microseconds, so that very rapid switching among several plasma loops is possible. The plasma loop readers in the sensor can be arranged in a variety of configurations, including a sphere, a cylinder or other geometric shape. The terminals of each plasma loop reader in the configuration are connected to the power source via a switching circuit and to the sensor circuit.

In a further embodiment of the plasma loop readers, they may have several loops of different diameter joined at a common side. That is, there is a common area at the terminals where a portion of the circumference of each loop is the same. When a frequency switch is used in connection with the power source, the power frequency used to activate the plasma loops can be varied to change the frequency at which the plasma loop reader is active. The particular diameter loop in which the plasma is active in the plasma loop sensor is also changed by changing the active transmission frequency.

In yet another alternative of the near-field plasma reader, the plasma loops are replaced by metal loops with sections of plasma loop which can be turned on and off. The plasma loop sections are sufficiently large so that when they are turned off, or made inactive, the metal loop is opened enough that it rendered electromagnetically invisible and no longer interferes with any surrounding active loop readers. The plasma loop sections are connected to the power source in the same manner as the full loops and can be switched in the same way.

It is intended that the sensor circuit connected to the antennas in the array will be capable of interpreting data received from existing types of passive loops commonly used in security devices and the like. The plasma loop sensor interacts with existing passive loops in the same manner as metal loop sensors, but does not suffer from detuning or interference from surrounding loop sensors.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1A:
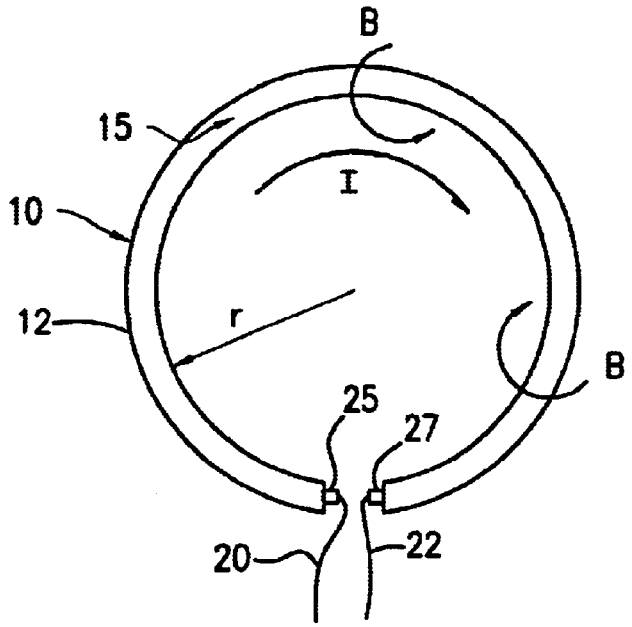
FIG. 1A is a front elevation view of a plasma loop antenna of the invention.

Referring now to the drawings, in which like reference numerals are used to refer to the same or similar elements, FIG. 1A shows a plasma loop sensor 10 primarily comprising a tube 12 having electrodes 25, 27 at each end. The tube 12 is bent into a circular loop. A pair of leads 20, 22 are attached to the electrodes 25, 27 for connecting the tube 12 to a power source (not shown in FIG. 1A).

The tube 12 of the plasma loop sensor 10 contains a gas 15 inside the plasm loop sensor 10. The gas 15 may be neon, xenon, argon or other noble gases. The gas 15 can be ionized to form a plasma in the tube 12 by applying energy to the gas 15 using any of several devices including electrodes 25, 27, inductive couplers, capacitive sleeves, lasers or RF heating.

When the gas 15 is ionized, a current I begins to flow between the electrodes 25, 27, which in turn generates a magnetic field having a magnetic flux B. The magnetic field is generated in a direction perpendicular to the plane of the loop antenna 10. The magnetic field is characteristic of the current I and voltage used to power the plasma in the tube 12.

The plasma loop sensor 10 optimal magnetic induction range is equal to the radius r of the loop. The plasma loop sensors 10 may be made any size as is practical and required by a particular application. For purposes of the invention herein, however, the preferred radius for the plasma loop antennas is between 0.5 cm and 100 cm. Further, it should be noted that although the optimal range of the plasma loop sensors 10 is limited by the radius of the loop, the sensors 10 are still effective across a wider range of distances.

The plasma loop sensors 10 may be switched on and off in a matter of 1–10 microseconds, with rapid rise and decay times, so that very rapid switching of the plasma loop readers 10 is possible.

The frequency of the ionization energy source also affects the plasma magnetic field radiation frequency. It is possible for the sensors 10 to radiate at frequencies in the range of 0.1 MHz to 100 Ghz.

Figure 1B:
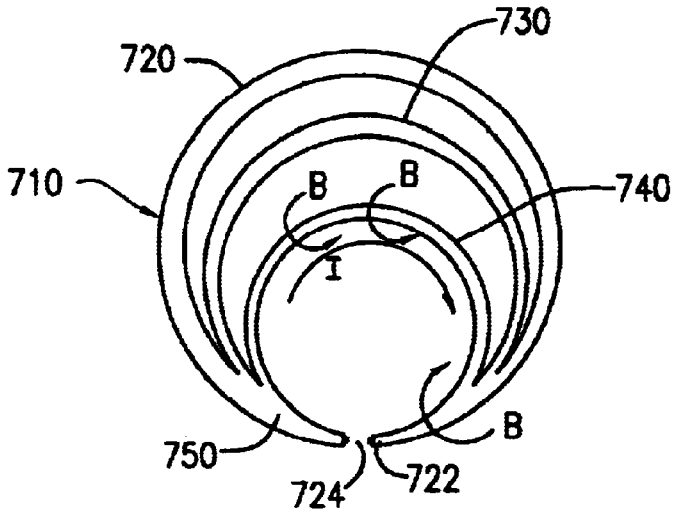
FIG. 1B is a front elevation view of an alternative plasma loop sensor according to the invention.

The plasma loop reader of FIG. 1B is a multiple loop plasma reader 710 having three different diameter tubes 720, 730, 740 with a common tangential side 750 and electrodes 722, 724. A gas inside the tubes can be ionized to different excitation levels depending on the energy applied at the electrodes 722, 724. The different ionization levels correspond to different radiant frequencies for the electromagnetic fields generated by the plasma reader 710. Thus, the multiple loop plasma reader 710 can be used to generate multiple transmission frequencies or to receive on different frequencies from transmission by changing the energy supplied to the plasma loop reader 710.

Figure 2:
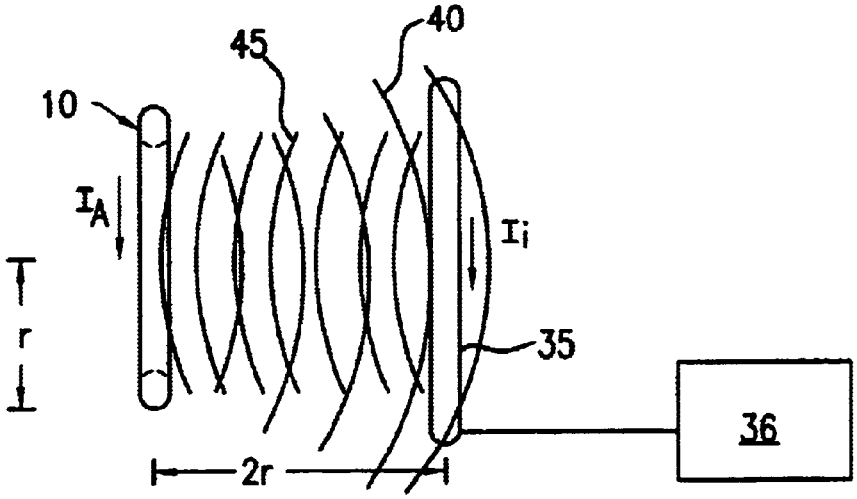
FIG. 2 is a side elevation view diagram of the magnetic field interaction between a plasma loop sensor of FIG. 1 and a passive loop.

FIG. 2 illustrates the interaction of a magnetic field 40 of a plasma loop sensor 10 with a passive metal loop 35. Plasma loop sensor 10 has a plasma current of $I_A$ which generates magnetic field 40 around the loop 10. The magnetic field 40 is sufficiently strong to at least effectively extend a distance of about twice the radius r of the loop 10 to passive loop 35. Magnetic field 40 induces a current $I_i$ in the passive loop 35.

Passive loop 35 includes a frequency changing circuit 36, which operates on induced current $I_i$ to alter the frequency of the received magnetic field and produce a frequency-changed response magnetic field. The frequency changing circuit 36 causes the induced current $I_i$ to have the altered frequency. The circuit 36 may be connected to the terminals of the passive loop 35 in a known manner. Passive loop 35 and frequency changing circuits 36 known in the prior art disclosed herein, for example, may be used for these components.

The induced current $I_{i,}$ with a different frequency from the plasma current $I_A$, generates a response magnetic field 45 emanating from the passive loop 35. The response magnetic field 45 is also sufficiently strong so as to interact with the plasma loop sensor 10. As described further below, the plasma loop sensor 10 can also operate in a receive mode to detect response magnetic field 45. In the receive mode, the plasma loop sensor 10 has a second induced current that is different from plasma current $I_A$, with characteristics corresponding to the response magnetic field 45.

It should be noted that if the response magnetic field 45 is varied in response to a changing induced current $I_i$ controlled by the frequency changing circuit 36, that more complex communication is possible, such as transmission of an identifying code in addition to simply indicating the presence of the passive loop 35.

Thus, a single plasma loop sensor 10 can be used to detect the presence of a passive loop 35 and receive communications therefrom. However, the ability of the plasma loop sensor 10 to generate the induced current $I_i$ so that a response magnetic field is subsequently generated and received is dependent in part on the relative orientation of the plasma loop sensor 10 and passive loop 35 to each other. The loops 10, 35 must be oriented parallel to each other, as shown in FIG. 2, so that the interaction between the generated magnetic fields 40, 45 is maximum. As the relative orientation between the antennas 10, 35 changes from parallel to perpendicular, the field interaction with the antennas 10, 35 goes from maximum to zero.

To solve this problem, there are two primary solutions. One is to physically move the loops 10, 35 relative to each other to cover different orientations. The other is to create an array of several differently oriented plasma loop sensors 10 that can be sequentially activated to send and receive magnetic fields 40, 45.

In the latter case, plasma loop sensors 10 provide the benefit that they can be easily switched on and off rapidly in sequence. Further, plasma loop sensors 10 can be arranged in any type of sequentially-fired array without affecting adjacent ones of the plasma loop sensors 10 because when the gas 15 is not being ionized to form plasma, the inactive sensor 10 is electromagnetically invisible to another, active plasma loop sensor 10.

Figure 3:
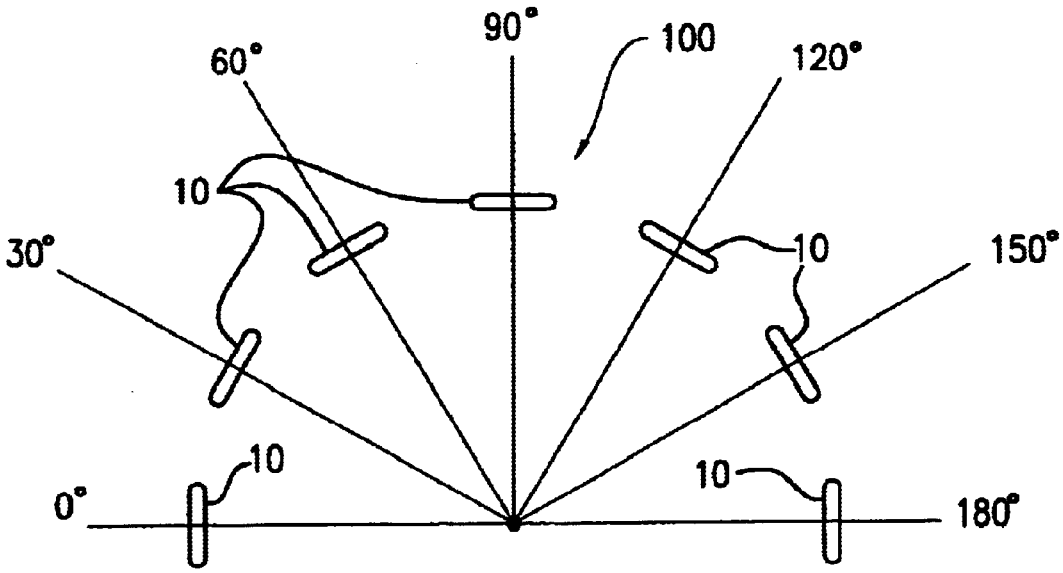
FIG. 3 is a diagram of an array of plasma loop readers at different orientations.

An example of an array 100 is shown in FIG. 3, in which seven plasma loop sensors 10 are arranged co-planar directed to different angles at 30° intervals. Although the plasma loop sensors 10 are shown arranged in an arc, this is only for purposes of illustrating the rotation to different angles and is not required. The plasma loop sensors 10 may be arranged co-linear as well, with each loop sensor 10 being rotated 30° from the facing of the previous loop sensor 10. Further, the angular rotation from one antenna to the next may be more or less than 30°, depending on the number of plasma loop sensors 10 in the array 100 and the desired effective range of each plasma loop sensor 10 based on both the expected distance and angular orientation offset from a passive loop 35.

Each plasma loop sensor 10 has its electrodes connected to a transmitting and receiving circuit (not shown in FIG. 3) with switching between modes and loop sensors 10, such as will be described in more detail below.

Figure 4:
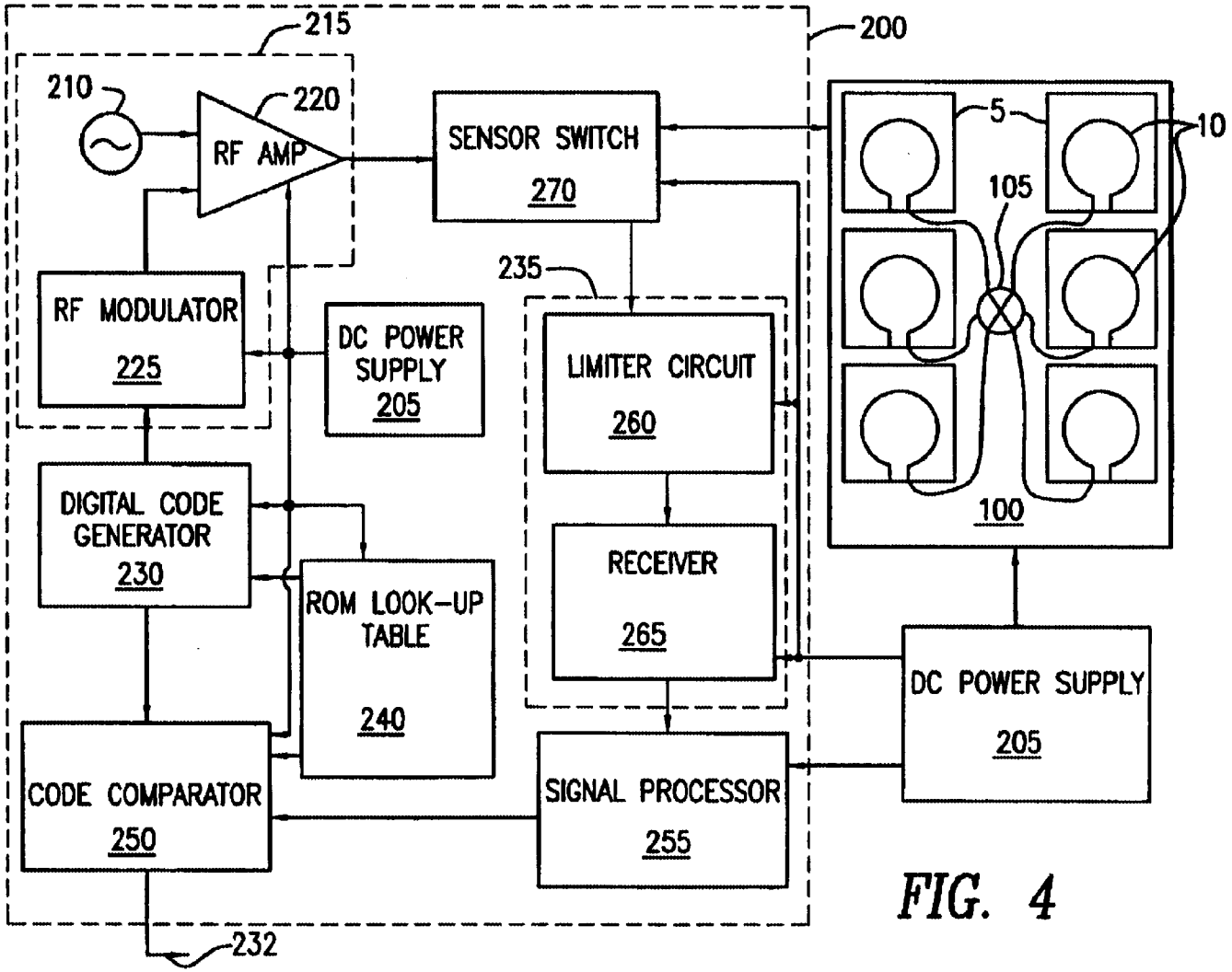
FIG. 4 is a schematic diagram of a transceiver circuit for use with a plasma sensor system.

FIG. 4 diagrams one possible transceiver circuit 200 for use with an array 100 of plasma loop antennas 10 mounted in substrates 5 for protection during use. A DC power supply 205 is connected to a mixer 210 and an analog to digital converter 230. The power supply 205 is preferably one which provides standard digital and other voltages needed for operating the circuit components.

The transmit segment 215 of the circuit 200 includes RF CW oscillator 210 having its output connected to an RF amplifier 220. The RF amplifier 220 combines a CW signal from the oscillator 210 with a modulated signal from a connected RF modulator 225 and generates an amplified pulse modulated (PCM) signal having information for transmitting with the plasma loop sensors 10. The PCM signal is sent to the plasma loop sensor array 100 for energizing an active one of the plasma loop sensors 10 and creating a magnetic field.

The PCM signal may be varied using a digital code generator 230 connected to the RF modulator to produce different RF modulated signals. The varying PCM signal in turn provides a time-varying signal to the active plasma loop sensor 10 and results in a time-varying magnetic field being produced by the plasma in the active plasma loop sensor 10. The digital code generator 230 provides a code word from a look-up table stored in ROM 240. Changing the code word causes the RF modulator to produce different RF modulated signals.

The RF amplifier 220 outputs the PCM signal to sensor switch 270 connected to plasma loop sensor array 100. Sensor switch 270 controls switching between the transmit 215 and receive 235 circuit segments. Preferably, the sensor switch 270 cyclically alternates between transmit and receive modes.

A switch 105 within array 100 is used to sequentially switch power to the several plasma loop sensors 10 in array 100. Only one plasma loop sensor 10 is made active at one time; the remaining plasma loop sensors 10 do not receive any power so that they are effectively rendered invisible to the active sensor 10 and do not detune the active sensor 10. While a plasma loop sensor 10 is active, the sensor switch 270 provides at least one transmit/receive cycle for the active plasma loop sensor 10.

After the sensor switch 270 permits a transmit phase in which the active plasma loop sensor 10 generates a magnetic field, the sensor switch 270 changes to connect the active plasma loop sensor 10 to a receive segment 235 of the transceiver circuit 200.

The receive segment 235 includes a limiter circuit 260 for ensuring the received signal from the array is scaled within the operating range of a receiver 265. The limiter circuit 260 protects the receiver 265 from over-voltage instances in the received signals. The receiver then demodulates a coded reply RF PCM signal, which can be generated by interaction of the active plasma loop sensor 10 with a nearby passive loop. If necessary, the receiver can also amplify the received RF PCM signal to ensure proper decoding.

The transceiver circuit 200 includes components for interpreting the received signal. The demodulated coded reply signal is sent from the receiver 265 to a signal processor 255. The signal processor 255 conditions the coded reply signal for input into a code comparator 250. When the conditioned reply signal is input at the code comparator 250, the coded reply is compared to known or expected replies stored in a look-up table stored in ROM.

The result obtained by the code comparator 250 is sent to an output 232. The result may be information received from the passive loop or it may be a null if no passive loop was detected during the transmit/receive cycle.

The output 232 can be connected to any device capable of using the digital signal from the A/D converter. For example, in grocery scanning system, the output 232 may be connected to a cash register to provide price and item information received from a scanned object in a grocery bag.

Figure 5A:
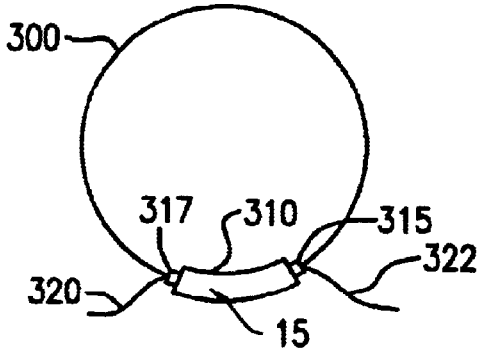
FIG. 5A is a front elevation view of a metal loop sensor with a plasma section.
Figure 5B:
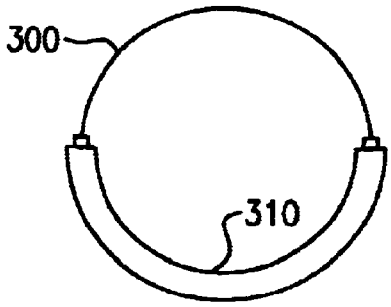
FIG. 5B is a front elevation view of an alternative embodiment of the metal loop sensor and plasma section of FIG. 5A.
Figure 5C:
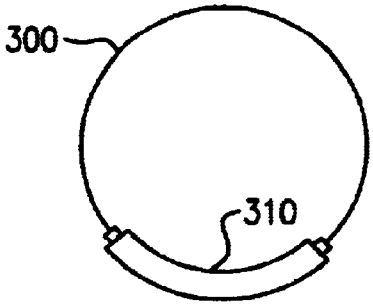
FIG. 5C is a front elevation view of a second alternative embodiment of the metal loop sensor and plasma section of FIG. 5A.

While loop sensors wholly composed of plasma tubes are preferred for use, FIGS. 5A–5C illustrate metal loop sensors 300 having plasma sections 310 which are electromagnetically equivalent to the plasma loop sensors 10 described above. The metal loop sensors 300 with plasma sections 310 are also magnetically invisible to adjacent loops when the plasma sections 310 are deactivated. That is, the plasma sections 310 are sufficiently long that when the ionizing energy is removed from the electrode terminals 315, 317, the loop circuit is broken so that a magnetic field will not generate a current in the metal loop 300. Since current cannot flow through the loop 300 except when the gas 15 is ionized to form plasma, the metal loop sensor 300 also appears invisible and does not cause detuning of surrounding sensors 10, 300 when it is inactive.

The plasma sections 310 act like switches for the metal loop sensors 300 to activate and deactivate them in the same manner as the plasma loop sensors 10 are activated and deactivated. When power is supplied to the plasma section 310 through leads 320, 322 and electrodes 315, 317, the metal loop sensor 300 is activated and transmits a magnetic field which can interact with other adjacent loop sensors. The metal loop sensors 300 can be connected to a circuit such as that shown in FIG. 4 in the same manner as the plasma loop sensors 10. Arrays of the metal loop sensors 300 can be connected, oriented and sequentially switched using the plasma sections 310 in the same manner as the plasma loop sensors 10 described herein as well.

The plasma section 310 can be as short as a 1° arc segment of the metal loop sensor 300, up to the entire circumference, less a gap for electrodes, so that it is the same as plasma loop sensor 10. However, when the metal loop sensor 300 embodiment of the loop sensors 10 is used, it is preferred that the plasma section 310 is an arcuate segment between about 1° and 10° long.

Figure 6:
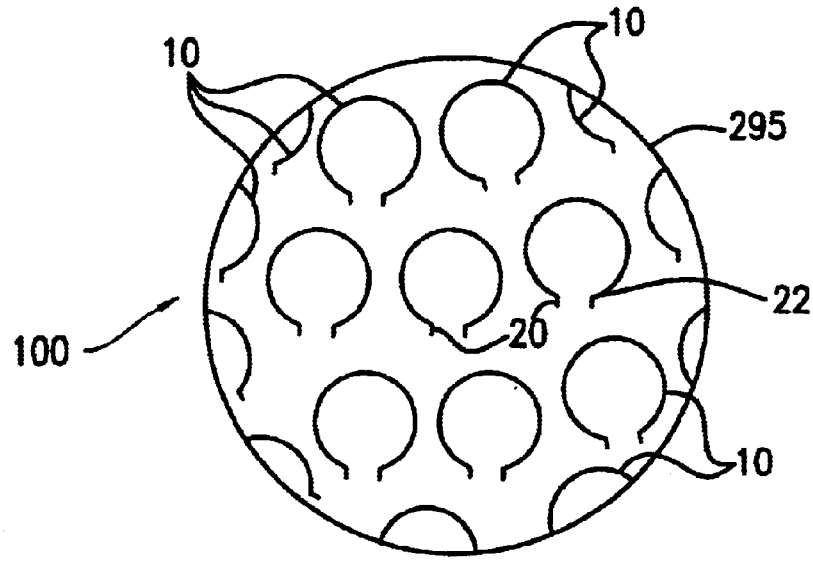
FIG. 6 is a front perspective view of an array of plasma loop readers mounted in a spherical substrate.
Figure 7:
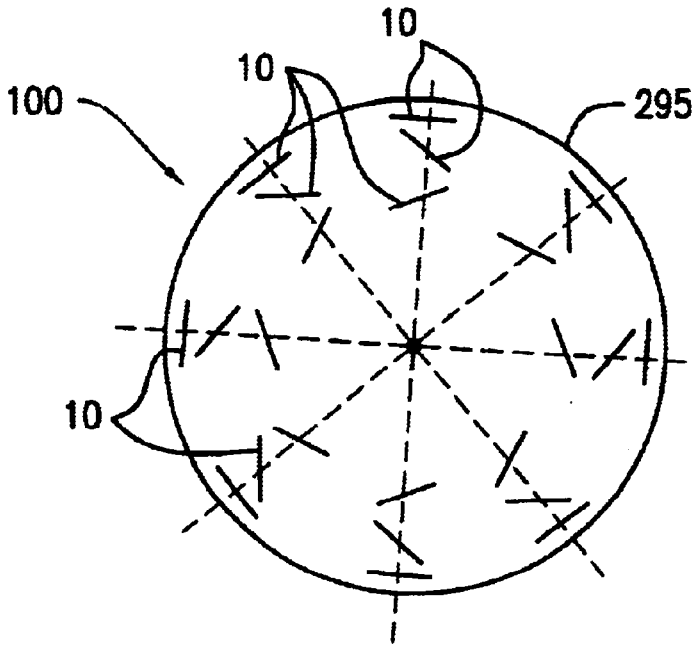
FIG. 7 is a sectional top plan view of an alternative embodiment of the array of FIG. 6 taken across an equator of the spherical substrate.
Figure 8:
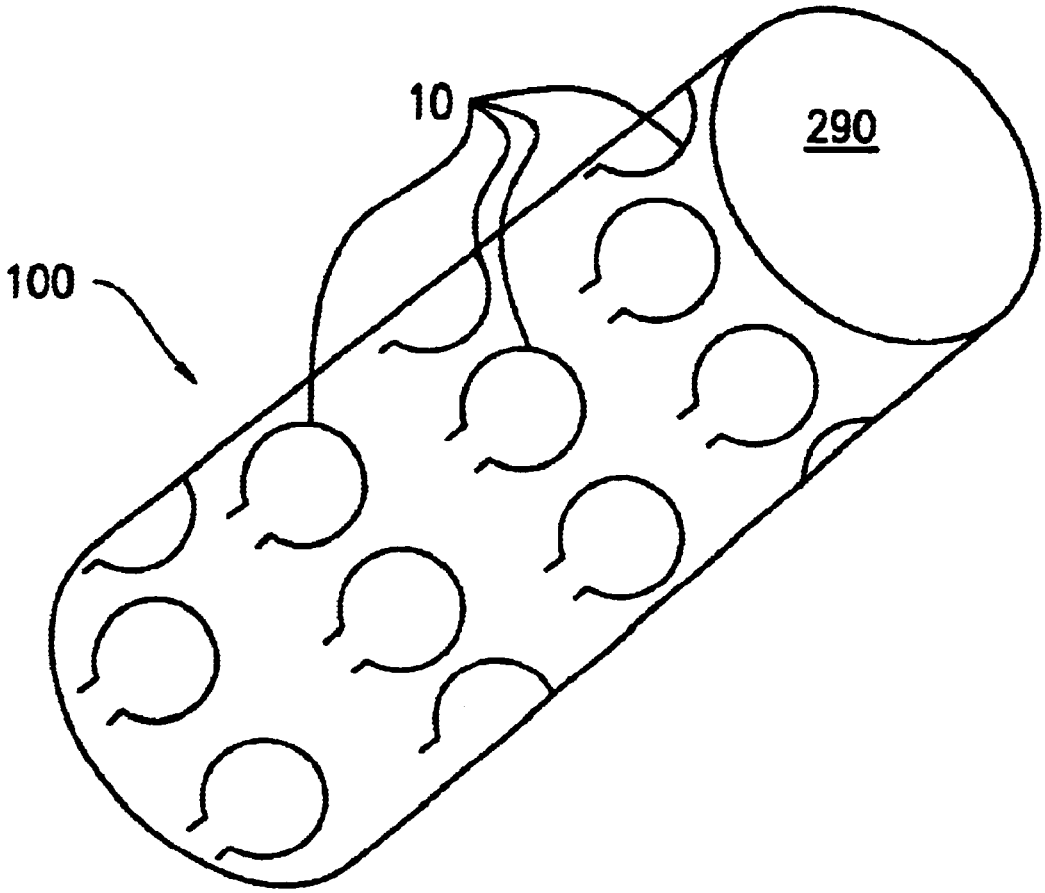
FIG. 8 is a front perspective view of a cylindrical substrate holding an array of plasma loop sensors.

FIGS. 6–8 illustrate scanning arrays 100 of plasma loop readers 10 supported in rigid substrates 290, 295.

In FIG. 6, a spherical non-magnetic substrate 295 supports an array 100 of plasma loop readers 10 on its surface. The substrate 295 is selected so that it does not interfere with the magnetic fields and electrical properties of the plasma loop sensors 10. Although non-magnetic substrates are preferred, it should be understood that ferrite materials may be used for the substrate as well.

The terminal leads 20, 22 of each plasma loop sensor 10 are connected to a switching transceiver (not shown in FIG. 6), such as one like that illustrated in FIG. 4, so that each plasma loop sensor 10 may be sequentially activated.

The plasma loop sensors 10 are arranged around the surface of the sphere oriented along many different radii of the sphere. The orientation of the plasma loop sensors 10 allows sequential scanning of a broad range of angles for corresponding passive loops 35 within the effective range of the plasma loop sensors 10. Since the orientations of the plasma loop sensors 10 varies across the surface of the spherical substrate 295, the substrate itself does not need to rotate. The sequential activation of the plasma loop sensors 10 virtually rotates the scanning angle without moving the substrate 295. Clearly, when the substrate 295 is spherical, a wide range of angles can be scanned for corresponding receiving loops in objects carrying the receiving loops.

FIG. 7 illustrates another embodiment of the spherical substrate 295 having an array 100 of plasma loop readers 10 embedded within the thickness of the substrate 295. The substrate 295 is shown with the top half of the sphere removed. As can be seen, the plasma loop readers 10 are oriented at different angles along each of several axes of the sphere. The orientations of the plasma loop readers 10 are selected to maximize the scanning coverage of the array 100. As in FIG. 6, the plasma loop readers 10 are each connected to a switch and transceiver circuit (not shown in FIG. 7) for sequential activation to ensure there is no electromagnetic interference between plasma loop readers 10 in the array 100.

In FIG. 8, a cylindrical substrate 290 has an array of plasma loop sensors 10 arranged around the surface of the substrate 290. The substrate is selected to have the same properties as the spherical substrate 295. The cylindrical substrate 290 scans for corresponding receiving passive loops located around the axis of the cylinder within the effective range of the plasma loop sensors 10. The cylindrical substrate 290 with the plasma loop sensors 10 mounted only on the surface is limited compared to the spherical substrate 295 in that only two axes of receiving passive loop orientations can be fully scanned versus three.

However, if the plasma loop sensors 10 are embedded in a cylindrical substrate 290 around the surface and oriented rotated about the cylinder radial axis to different angles, then all three axes can be scanned with a sensor array using the cylindrical substrate 290. That is, passive loops oriented perpendicular to the longitudinal axis of the cylindrical substrate 290 could be detected as well.

Arrays 100 of the plasma loop readers 10 can be used in a variety of scanning applications to detect a receiving passive loop, such as the one shown in FIG. 2.

Figure 9:
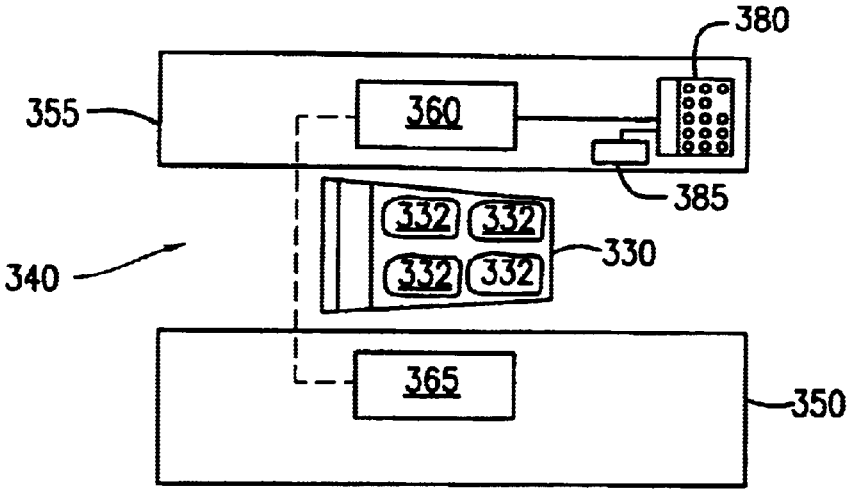
FIG. 9 is a top plan view diagram of a grocery or department store checkout using a plasma loop sensor array of the invention.
Figure 10:
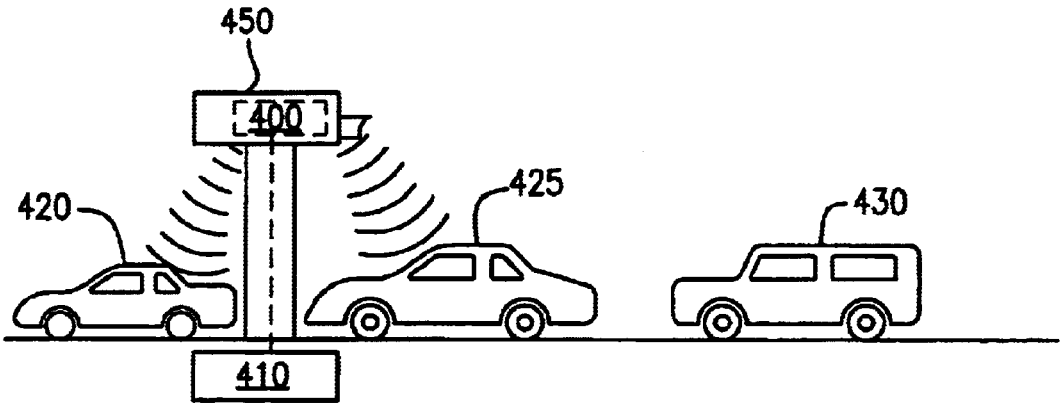
FIG. 10 is a side elevation view of a diagram of a toll collection system using plasma loop arrays according to the invention.
Figure 11:
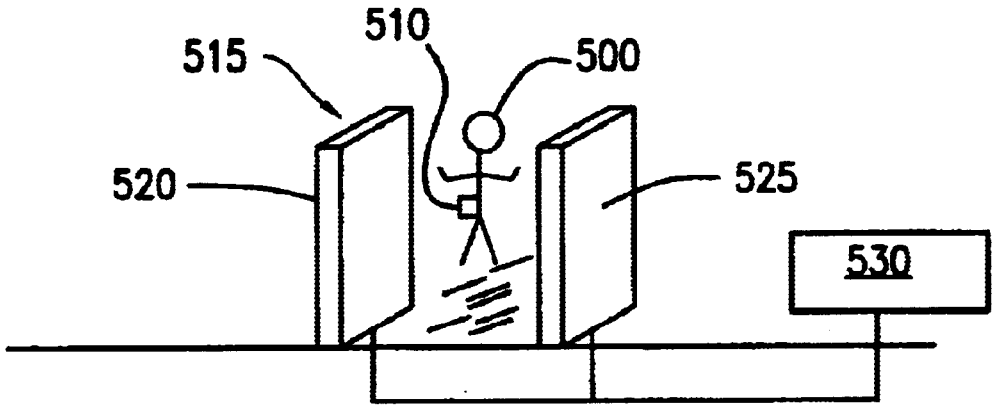
FIG. 11 is a front perspective view diagram of a security gate system using a plasma loop scanning array according to the invention.

FIGS. 9–11 depict different scanning applications for arrays of the plasma loop sensors which take advantage of the fact that the array itself does not need to move physically to scan a wide range of angles, as discussed above.

In FIG. 9, a checkout lane 340 of a grocery or department store is shown having a cart 330 containing packages or bags 332 containing goods. Depending on the circumstances, either the packages or the goods are each encoded with a unique receiving passive loop (not shown). The lane 340 has two counters 350, 355 each having a plasma loop scanner 360, 365 located vertically at about the level of the bags 332 in the cart 330. Each plasma loop scanner includes an array of plasma loop sensors and a switching and transceiver circuit for sequentially activating each sensor in the array to query the goods in the bags 332. The outputs of the transceiver circuits are connected to a cash register 380 for ringing up each unique goods detected in the cart 330 and completing the sale.

The scanners 360, 365 use an array such as the spherical or cylindrical arrays of FIGS. 6–8, or a semi-sphere array which scans the 180° in the lane 340. The semi-sphere array can be created by cutting the spherical substrate 295 in half and using only one half. The arrays are connected to a transceiver circuit like that of FIG. 4, or another circuit having a similar function.

When the transceiver of FIG. 4 is used, the ROM 240 provides a look-up table for identifying each uniquely coded object having a receiving passive loop that is detected by the scanners 360, 365. Either of the cash register 380 or the scanners 360, 365 includes a logic circuit or computer for determining when the same receiving passive loop is detected by a subsequently activated plasma loop sensor in the array. The logic circuit or computer ignores the duplicate detection, while passing newly detected goods to the cash register 280 for pricing and totaling the purchase.

The scanner system of FIG. 9 provides a checkout line in which it is unnecessary for a customer to unload the cart 330 for a clerk to individually scan items in the bags 332. The contents of the bags 332 can be determined solely by using the scanners 360, 365. Further, depending on the effective range of the arrays in the scanners 360, 365, only one of the scanners may be needed. Where the distance across the lane 340 is too great for a scanner 360 from one side to effectively detect receiving sensors on the far side of the lane, the second scanner 365 can be used as well.

Used in combination with a known debit and credit card terminal 385 connected to the cash register 380, a single clerk can effectively manage several checkout lanes 340 at once, since the checkout is fully automated except when cash or a check is used as payment. Consumers can bag their goods as they shop since it is not necessary to remove the items for checkout, further eliminating wasted checkout time.

FIG. 10 illustrates a toll collection system in which a toll gate 450 is equipped with a scanner 400 connected to a transaction manager 410. The scanner 400 includes an array of plasma loop readers 10, 300 as in the checkout lane scanners 360, 365. The array is used to rapidly sequentially scan for receiving passive loops oriented in a range of angles on cars 420, 425, 430 passing underneath the toll gate 450.

Each car 420, 425, 430 that will use the system is assigned a unique receiving sensor for identifying the car. The transaction manager 410 contains logic programming for determining whether a particular car 420, 425, 430 has been scanned already or if it is unique from prior scanned cars. The toll gate 450 may contain anti-fraud devices as well, such as weight-triggered checks against whether a receiving passive loop was detected or human toll collectors who can monitor the system.

As will be appreciated, the horizontally and vertically oriented scanners described above can be used in wide range of applications where an object coded with a unique receiving passive loop passes below or adjacent a scanning array of plasma loop sensors. Further, the particular vertical or horizontal orientation shown in the examples is not intended to be limiting, as the scanners could be oriented to any fixed position which is more practical, subject to ensuring the plasma loop readers in the scanner are oriented to scan the appropriate area.

And, when a unique identification is not required, but merely detection, the receiving passive loop in the object to be detected does not need to include a unique code. The scanning array is used to simply detect the presence of the receiving passive loop and generate an alert, such as in a store security system or another gated area for holding animals or objects carrying receiving passive loops having a scanner at the gate.

As an example, in another embodiment of a scanning system, FIG. 11 shows a gate 515 having two walls containing scanners 520, 525 connected to an alarm system 530. A person 500 has a card 510 or other substrate carrying a receiving passive loop. If the person 500 passes through the gate 515 with the card 510, the plasma loop sensors in the scanners 520, 525 will detect the presence of the card 510 by interaction with the passive loop and the alarm system 530 will generate a response, such as shutting the gate 515, sounding a siren or making a light flash. Such a scanning system can be used for ensuring certain persons do not exit a gated area, provided compliance with carrying the card 510 can be guaranteed.

Alternatively, the card 510 may contain a uniquely coded identifier for the person 500. The card 510 can be coded to permit access through some gates 515 without sounding an alarm, while passing others will activate the alarm. In such cases the scanners 520, 525 and alarm system 530 include a code table for interpreting which card 510 is passing the gate 515 and determining the permissions associated with the card 510 before sounding an alarm or preventing passage.

It should be understood that any one or a combination of the plasma loop sensor 10, metal loop sensor 300 with plasma section 310 or multiple loop plasma sensor 710 can be used in the arrays and scanning systems described herein.

Further, although the sensed loops 35 are referred to herein as passive loops, it is envisioned that the sensed loops can be active also, so as to produce their own magnetic field. For example, a lithium battery source could be connected with the sensed loop and frequency changing circuit like that shown in FIG. 2 to power the sensed loop and circuit. The principles of near-field induction are not changed and the plasma loop sensors 10, 300 can still detect the presence or absence of such active sensed loops, as well as receive information from the sensed loops.

While a specific embodiment of the invention has been shown and described in detail to illustrate the application of the principles of the invention, it will be understood that the invention may be embodied otherwise without departing from such principles.

What is claimed is:

1. A near-field plasma loop scanner, comprising:

a plurality of plasma loop sensors arranged in an array to scan in a plurality of different directions;

switching means for sequentially activating each of the plurality of plasma loops sensors; and transceiver means for energizing an activated one of the plurality of plasma loop sensors to alternately generate a magnetic near-field signal and receive a responsive magnetic near-field signal from a sensed loop within the near-field effective range of the activated one of the plurality of plasma loop sensors.

2. A near-field plasma loop scanner according to claim 1, wherein the array is one of a cylindrical, spherical and semi-spherical array.

3. A near-field plasma loop scanner according to claim 1, wherein the transceiver means include codec means for coding the generated magnetic near-field signal with a code word and decoding the responsive magnetic near-field signal.

4. A near-field plasma loop scanner according to claim 3, further comprising an output, wherein a result obtained from decoding the responsive signal is generated at the output.

5. A near-field plasma loop scanner according to claim 1, wherein the plurality of plasma loop sensors are oriented in the array at a plurality of angles along first and second axes, the first and second axes being perpendicular to each other.

6. A near-field plasma loop scanner according to claim 5, wherein at least a portion of the plurality of plasma loop sensors arranged along each of the first and second axes are rotated at different angles about the other one of the axes.

7. A near-field plasma loop scanner according to claim 1, wherein the plurality of plasma loop sensors are mounted in a non-magnetic substrate.

8. A near-field plasma loop scanner according to claim 7, wherein the substrate is shaped one of cylindrical, spherical, and semi-spherical.

9. A near-field plasma loop scanner according to claim 8, wherein the plurality of plasma loop sensors are mounted only on the surface of the substrate.

10. A near-field plasma loop scanner according to claim 8, wherein the plurality of plasma loop sensors are embedded throughout the substrate.

11. A near-field plasma loop scanner according to claim 1, wherein the plasma loop sensors comprise a plasma tube having electrodes at the ends thereof for receiving power to ionize a gas inside the plasma tube and form a plasma, the tube shaped as a loop having a gap between the ends.

12. A near-field plasma loop scanner according to claim 1, wherein the plasma loop sensors comprise a first arcuate section of a plasma tube having means for generating a plasma inside the plasma tube and a second arcuate section of a conductive metal, the first and second arcuate sections in electrical contact with each other and forming a conducting loop when the plasma is generated.

13. A plasma loop sensor for detecting a second loop using near-field magnetic inductance, the plasma loop sensor, comprising:

a loop, at least a portion of which is an arcuate tube, the tube defining a chamber, and a second portion of the loop being formed by a conductive metal electrically connected with the arcuate tube;

an ionizable gas contained in the chamber; and a pair of electrodes, one electrode connected to each of the ends of the tube, wherein when a power source is applied to the tube across the electrodes, the ionizable gas is energized to form a plasma inside the tube thereby generating a magnetic field, the loop being non-conducting when the plasma is absent.

14. A plasma loop sensor according to claim 13, further comprising transceiver means for alternately applying power to the tube across the electrodes to generate a magnetic near-field signal with the plasma and detecting a responsive signal resulting from near-field magnetic induction interference with the second loop.

15. A scanning system for detecting an object having a receiving loop antenna using magnetic induction in a near-field range, the scanning system comprising:

a plurality of plasma loop sensors arranged in an array for scanning a plurality of different directions using near-field magnetic induction;

a switch for sequentially activating each one of the plurality of plasma loop sensors;

a transceiver for alternately transmitting a scan signal and receiving a response signal with each one of the sequentially activated plasma loop sensors;

indicator means for using an output from the transceiver based on the response signal received by each of the plurality of plasma loop sensors to indicate when the object having the receiving loop is detected.

16. A scanning system according to claim 15, wherein at least one of the plurality of plasma loop sensors comprises a first arcuate section of a plasma tube having means for generating a plasma inside the plasma tube and a second arcuate section of a conductive metal, the first and second arcuate sections in electrical contact with each other and forming a conducting loop when the plasma is generated.

17. A scanning system according to claim 15, wherein the array of plasma loop sensors is one of a spherical array, a cylindrical array and a semi-spherical array.

18. A scanning system according to claim 15, wherein the indicator means is selected from the group consisting of an alarm system, a toll gate and a store cash register.

19. A scanning system according to claim 15, wherein the plurality of plasma loop sensors are provided on a substrate.

20. A scanning system according to claim 19, wherein the plasma loop sensors are located one of only on the surface of the substrate and embedded within the substrate.

* * * * *